US007152766B1

(12) United States Patent
Walsh et al.

(10) Patent No.: US 7,152,766 B1
(45) Date of Patent: Dec. 26, 2006

(54) METAL RE-SEALABLE BEVERAGE CONTAINER WITH POUR SPOUT

(75) Inventors: William Walsh, Lombard, IL (US); Gopalaswamy Rajesh, Lake Zurich, IL (US)

(73) Assignee: Rexam Beverage Can Co., Chicago, IL (US)

( * ) Notice: Subject to any disclaimer, the term of this patent is extended or adjusted under 35 U.S.C. 154(b) by 167 days.

(21) Appl. No.: 10/932,479

(22) Filed: Sep. 1, 2004

(51) Int. Cl.
*B67D 3/00* (2006.01)
*B67D 5/06* (2006.01)

(52) U.S. Cl. ..... 222/529; 222/530; 222/574; 222/541.6; 220/62.17; 215/347; 215/12.1

(58) Field of Classification Search ..... 222/527, 222/528, 107, 143, 207, 572–575, 541.5, 222/541.6, 533, 534, 530, 529; 220/62.17, 220/626, 627, 359.3; 215/12.1, 347, 364
See application file for complete search history.

(56) References Cited

U.S. PATENT DOCUMENTS

| | | | | | |
|---|---|---|---|---|---|
| 2,337,616 | A | | 12/1943 | McManus et al. | 220/29 |
| 2,895,654 | A | | 7/1959 | Reike | 222/259 |
| 3,199,750 | A | | 8/1965 | Livingstone | 222/529 |
| 3,613,966 | A | | 10/1971 | Summers | 222/529 |
| 3,690,522 | A | | 9/1972 | Chlystun | 222/529 |
| 3,813,000 | A | * | 5/1974 | Underwood | 220/269 |
| 3,967,753 | A | * | 7/1976 | Cudzik | 220/269 |
| 4,219,137 | A | * | 8/1980 | Hutchens | 222/462 |
| 4,838,448 | A | * | 6/1989 | Piano | 220/257.2 |
| 4,937,110 | A | | 6/1990 | Ohara et al. | 428/34.2 |
| 5,080,249 | A | * | 1/1992 | Shock | 220/269 |
| 5,310,068 | A | * | 5/1994 | Saghri | 215/386 |
| 5,348,173 | A | | 9/1994 | Norwood | 215/10 |
| 5,355,710 | A | | 10/1994 | Diekhoff | 72/379.4 |
| 5,557,963 | A | | 9/1996 | Diekhoff | 72/379.4 |
| 5,642,826 | A | | 7/1997 | Melrose | 215/382 |
| D384,888 | S | | 10/1997 | Diekhoff | D9/500 |
| 5,704,240 | A | | 1/1998 | Jordan | 72/103 |
| 5,713,235 | A | | 2/1998 | Diekhoff | 72/352 |
| 5,718,352 | A | | 2/1998 | Diekhoff et al. | 220/669 |
| 5,753,328 | A | | 5/1998 | Miyazawa et al. | 428/35.8 |
| 5,769,262 | A | | 6/1998 | Yamada et al. | 220/592.17 |

(Continued)

FOREIGN PATENT DOCUMENTS

| | | |
|---|---|---|
| WO | WO 8200020 | 1/1982 |

(Continued)

*Primary Examiner*—Kevin Shaver
*Assistant Examiner*—Stephanie E. Tyler
(74) *Attorney, Agent, or Firm*—McDonnell Boehnen Hulbert & Berghoff LLP

(57) ABSTRACT

An all-metal beverage can with a pour spout is disclosed. The can includes a can body for containing a beverage and a closure member. The closure contains a metal pour spout and a cap covering the pour spout. The pour spout and cap are in a recessed condition within the can body prior to opening the can, allowing the can to be shipped and stacked in the normal fashion. The closure further comprises a first layer forming the pour spout, a second layer forming the cap, and a scored area formed in the second layer. The cap separates from the closure by the user grasping the cap and breaking of the scored area (e.g., by twisting) and then removing the cap from the pour spout. When the container is opened, the pour spout is extendable from the can body to facilitate pouring of the beverage. In one possible embodiment, the pour spout is threaded. The cap threads onto the pour spout, enabling a resealing of the can.

29 Claims, 4 Drawing Sheets

U.S. PATENT DOCUMENTS

| | | | | |
|---|---|---|---|---|
| 5,770,290 | A | 6/1998 | McHenry et al. | 428/43 |
| 5,778,723 | A | 7/1998 | Diekhoff | 72/356 |
| 5,782,375 | A | 7/1998 | McHenry et al. | 220/62.12 |
| 5,816,428 | A | 10/1998 | Plester | 220/257.2 |
| 5,822,843 | A | 10/1998 | Diekhoff et al. | 29/512 |
| 5,862,939 | A | 1/1999 | McHenry et al. | 220/263 |
| 6,010,026 | A | 1/2000 | Diekhoff et al. | 220/288 |
| 6,010,028 | A | 1/2000 | Jordan et al. | 220/669 |
| 6,098,829 | A | 8/2000 | McHenry et al. | 220/62.12 |
| D436,539 | S | 1/2001 | Spreitzer et al. | D9/503 |
| 6,662,964 | B1 | 12/2003 | Higuchi | 220/667 |

FOREIGN PATENT DOCUMENTS

| | | |
|---|---|---|
| WO | WO 03101845 | 12/2003 |

* cited by examiner

METAL RE-SEALABLE BEVERAGE CONTAINER WITH POUR SPOUT

BACKGROUND OF THE INVENTION

A. Field of the Invention

This invention relates to the beverage can manufacturing art, and more particularly to a metal beverage can construction that has a resealable pour spout feature.

B. Description of Related Art

For many years, can manufacturers have attempted to arrive at an aluminum beverage can in which partially consumed contents can be resealed inside the can after the can has been opened. A can having such a feature presents obvious advantages to the consumer, such as avoidance of spills, the preservation of the freshness of the product, the preservation of carbonation of the product (in the case of soft drinks or beer), and the option to consume only a portion at one sitting and reserve the rest of the contents for later.

The prior art shows various attempts at resealable beverage containers, including Spreitzer, U.S. design patent D436,539 and Plester, U.S. Pat. No. 5,816,428. Other patents of interest relating to containers with pour spouts include Norwood, U.S. Pat. No. 5,348,173; Higuchi, U.S. Pat. No. 6,692,964; Melrose, U.S. Pat. No. 5,642,826; Chlystun, U.S. Pat. No. 3,690,522; Summers, U.S. Pat. No. 3,613,966; Reike, U.S. Pat. No. 2,895,654 and Livingstone, U.S. Pat. No. 3,199,750.

The Plester patent describes a pop-out pour spout in a convention can body. The present invention provides significant advantages over the design of the Plester patent, in that a can in accordance with the present invention can may be entirely made from metal and does not have plastic components, whereas the Plester patent has a substantial plastic component—the plastic spout. The presence of the plastic pour spout in the Plester patent prevents the Plester can from being recycled with ordinary aluminum cans; thus it presents a solid waste disposal issue. Conversely, the present inventive container can be made entirely of aluminum alloy and be recycled with other aluminum cans. Additionally, the Plester can be relatively cumbersome and difficult to open and requires more steps, and is thus less attractive to the consumer.

SUMMARY OF THE INVENTION

An all-metal beverage can with a pour spout is disclosed. The can includes a can body for containing a beverage and a closure or end for the can body. The closure contains a metal pour spout and a cap covering the pour spout. The pour spout and cap are in a recessed condition within the can body prior to opening the can, thus allowing the can to be shipped and stacked in the normal fashion. The closure further comprises a first layer forming the pour spout, a second layer forming the cap, and a scored area formed in the second layer. The cap separates from the closure by the user grasping the cap and breaking of the scored area and removing the cap from the pour spout (e.g., by twisting off the cap).

When the container is opened, the pour spout is extendable from the can body to facilitate pouring of the beverage from the can body. The pour spout may be moved to the extended position either by the action of the pressure from the contents of the can, or by the user grasping the pour spout and lifting it up.

In preferred embodiments, the layer construction is such that the second layer is of a relatively thicker supporting material, and voids are formed in the second layer in the region between the rim of the can body and the central pour spout. This construction weakens the closure sufficiently after the score region is fractured such that the pour spout can be moved to the extended position after opening. When the pour spout extends, the surrounding closure material flexes from a concave shape to a convex shape, due to the lightweight material used for the closure and the void features formed in the second layer.

In one possible embodiment, the pour spout further comprises a set of threads on the second layer (the external surface of the pour spout) and wherein the cap is adapted to thread onto the pour spout after separation from the closure enabling resealing of the beverage can.

In another aspect, a method is provided of manufacturing a beverage can with a re-sealable spout. The method comprises the steps of a) forming a closure as a laminate of a first layer of material and a second layer of material; a spout is formed in the first layer of material and a cap covering the spout is formed in the second layer of material; and b) affixing the closure to a can body. The affixing step can be by conventional seaming apparatus known in the art. The closure laminate is preferably, but not necessarily, constructed of aluminum alloys. In preferred embodiments, a scored area is provided in the second layer surrounding the base of the cap enabling the cap to be twisted off, revealing the spout in the first layer.

In yet another aspect, an end for a beverage can forming a closure on a can body is provided, comprising a laminate comprising a first layer forming a pour spout and a second layer forming a cap, the laminate forming the body of the end and substantially completely filling the space within a rim of the can body. A score pattern is formed in the second layer in an area surrounding the cap, the action of twisting the cap causing a rupture in the score pattern allowing the cap to be separated from the second layer and removed from the pour spout an allowing access to the contents of the beverage can.

DETAILED DESCRIPTION OF THE PREFERRED EMBODIMENTS OF THE INVENTION

Figure 1:
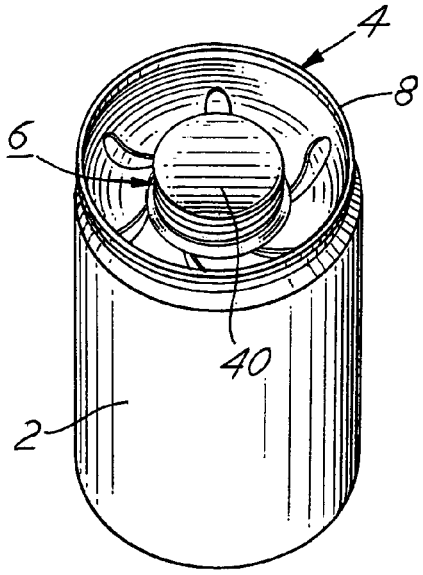
FIG. 1 is a perspective view of an embodiment of the inventive beverage can in a closed condition, showing the pour spout and closure nested within the upper region of the can.

Referring now to the drawings, primarily FIGS. 1, 2, 6, 9 and 12, a beverage can is shown having a can body 2 for containing a beverage, such as beer, juice, or carbonated beverages. The can body 2 is conventional. An end or closure 4 is seamed onto a flange forming the upper rim 8 of the can body 2 in a typical seaming process. The closure 4 nests within the upper region of the can body 2 when the can is in a closed condition. The closure 4 includes a pour spout 6 formed in the center of the closure. Note in FIG. 2 that the pour spout 6 does not protrude above the rim 8 of the can body, allowing the cans to be stacked and shipped in the conventional manner. It may be possible to have the pour spout 6 protrude slightly above the rim 8, as the pour spout 6 may nest within a dome feature in the bottom of the can body above it when the cans are stacked on top of each other.

Figure 6:
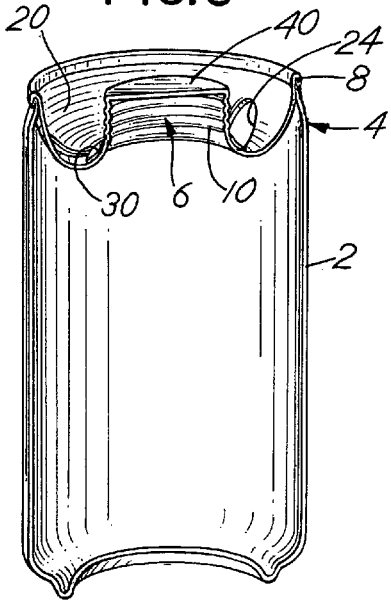
FIG. 6 is a perspective view, partially in cross section, of the can of FIG. 1, showing the layer construction of the closure.
Figure 7:
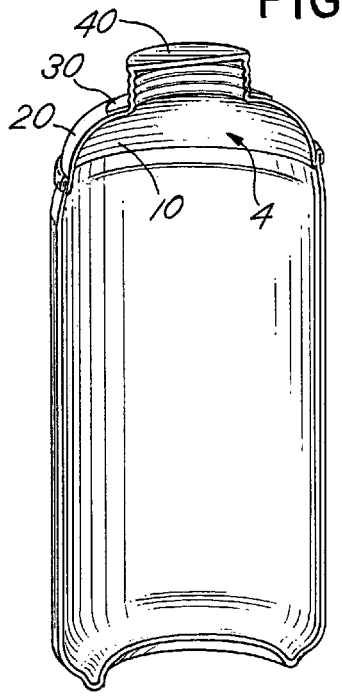
FIG. 7 is a perspective view, partially in cross section of the can of FIG. 3.
Figure 8:
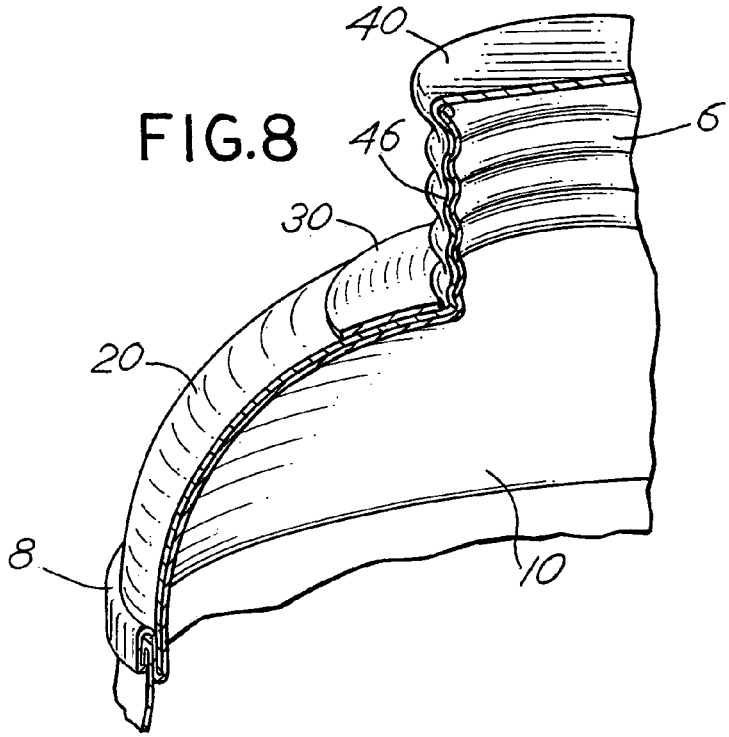
FIG. 8 is a more detailed perspective view, partially in cross-section, of the pour spout and closure when the closure is in its open, extended position.

As shown in FIG. 6, the closure 4 is of a layered or laminate construction and includes an inner layer of material 10. The inner layer is a continuous web of aluminum alloy in the illustrated embodiment. The inner layer 10 forms the pour spout 6.

Figure 2:
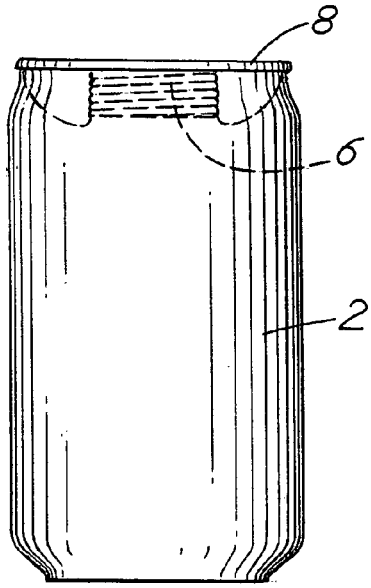
FIG. 2 is a side elevational view of the can of FIG. 1, with the closure shown in dashed lines. Note that the rim 8 forms the uppermost surface of the can.

The closure 4 further includes a second, supporting layer of material 20 that is laminated to the inner layer 10. The second layer 20 is also aluminum alloy in the illustrated embodiment. The second layer 20 is relatively thicker gauge material than the first or inner layer 10 in the preferred embodiment. The second layer 20 has a plurality of void features 24 formed therein in order to weaken the overall strength of the sandwich of the first and second layers and facilitate the closure inverting from its nested condition, as shown in FIGS. 1 and 2, to an extended position as shown in FIGS. 3, 4, 5 and 7. The second layer 20 extends substantially over the entire area of the closure 4 except for the presence of the voids 24. The cap 40 for the pour spout 6 is formed integral with the second layer 20.

Figure 5:
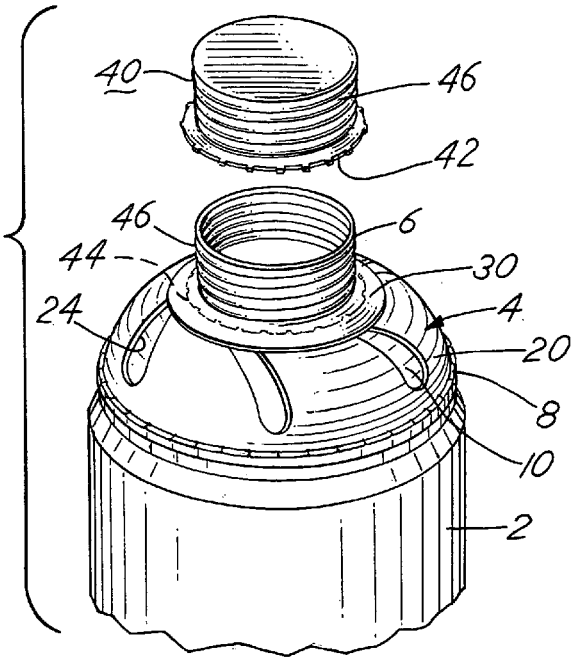
FIG. 5 is a detailed view of the upper region of the can of FIGS. 3 and 4 showing the separate cap and pour spout, and the threads that allow the cap to be screwed onto the pour spout after opening to reseal the can.
Figure 9:
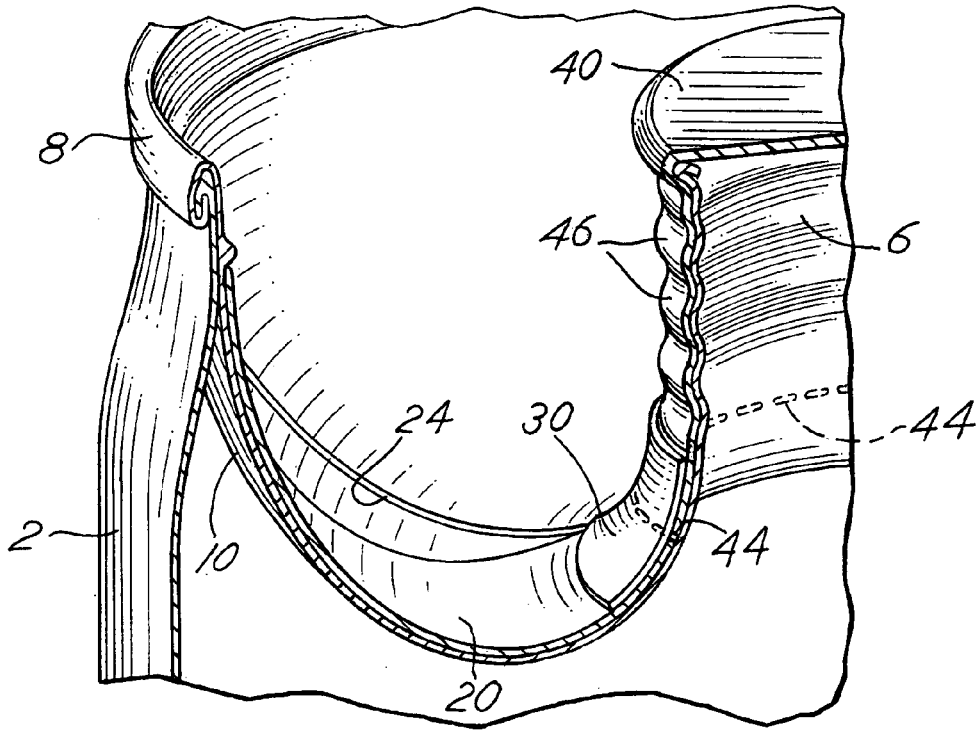
FIG. 9 is a more detailed perspective view, partially in cross-section, of the pour spout and closure when the closure is in its nested, closed position.
Figure 10:
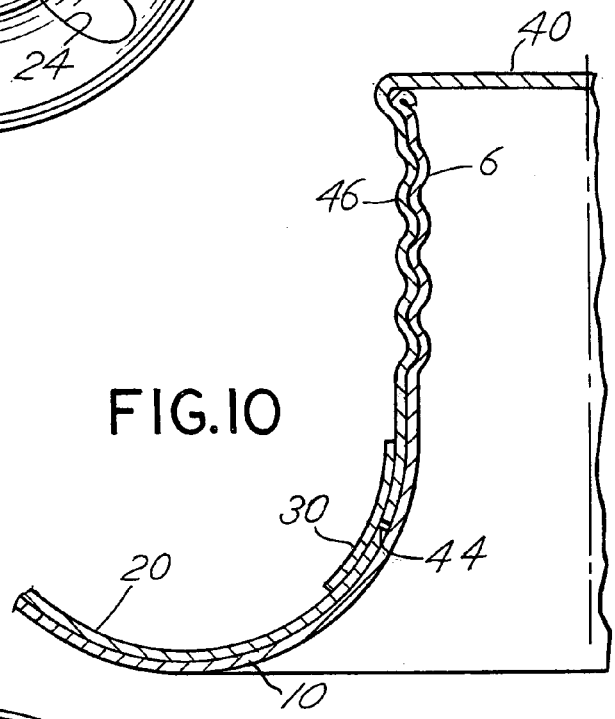
FIG. 10 is cross-sectional view of the pour spout, cap and layered construction of the closure, showing in more detail the scored area in the second layer and a pad that covers the scored area.
Figure 12:
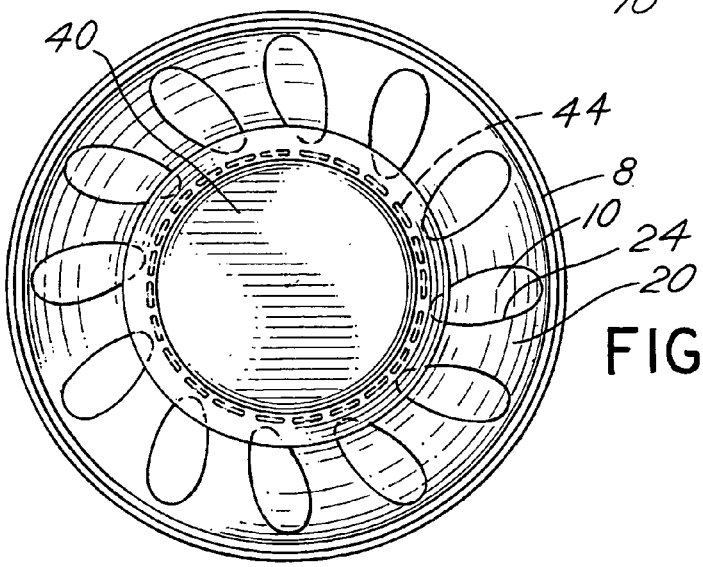
FIG. 12 is another top view of the can of FIG. 1, showing a score area in the center portion of the closure around the base of the pour spout and cap. When the user grasps the cap and twists it the score pattern is fractured allowing the cap to be removed from the pour spout and allowing access to the contents of the can.

A score pattern, shown best in FIGS. 9, 10 and 12 as reference 44, is formed in the second layer 20 in the region surrounding the base of the pour spout 6. The scores 44 are sufficient in area, number and depth, such that the user can grasp the cap 40 with one hand and hold the can body with the other hand and twist the cap with modest force such that the score pattern 44 in the second layer 20 is fractured, allowing the user to remove the cap 40 from the pour spout 6. The pour spout 6 and cap 40 preferably have complimentary threads 46 (FIGS. 5, 10) to allow the cap 40 to be threaded off of the pour spout 6 to remove the cap 40 and then threaded back onto the pour spout 6 to re-seal the beverage can. As shown in FIG. 5, the break in the score pattern 44 results in a lower edge 42 in the cap 40 after it is removed from the can.

As shown in FIGS. 3–9, a pad 30 is optionally provided in the beverage can in the area immediately above the score pattern 44. The pad 30, which may be made of any suitable material (including metal), covers the fractured score pattern 44 in the second layer 20 after the user has twisted off the cap 40 and prevents the user from being exposed to sharp edges in the score pattern 44 remaining in the second layer 20 on the closure 4 after opening the can.

Figure 11:
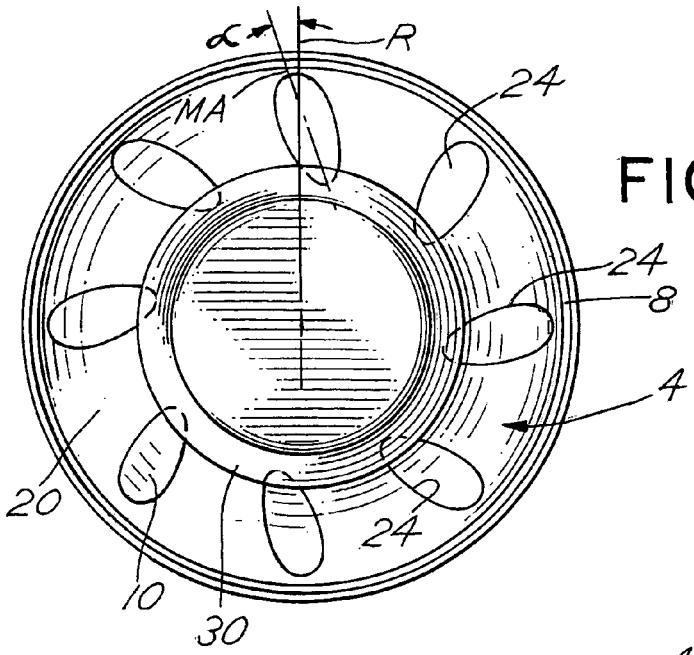
FIG. 11 is a plan view of the top of the can of FIG. 1 showing one possible pattern of void shapes formed in the second, supporting layer in the closure, and showing the angle α between the major axis MA of the voids and a line R drawn in a radial direction from the center of the closure and intersecting the major axis.

After the user opens the can by twisting off the cap 40, the user can then pull up on the pour spout 6 (either directly or by threading the cap 40 back onto the pour spout 6 and pulling up on the cap). This action causes the closure to move up to the extended, convex position as shown in FIGS. 3, 4, 5 and 8. The extended position facilitates consumption of the beverage directly from the can or pouring the contents into a glass. The voids 24 in the second layer are provided to weaken the overall strength of the combination of first and second layers and facilitate the extension of the closure 4. The voids 24 extend all the way to the scored pattern 44 in the illustrated embodiment. The voids 24 are shown as a pattern of elongate oval shapes in a regular pattern around the closure 4. As shown in FIG. 11, the voids 24 are oriented at a slight angle α between the major axis MA of the voids and a line R drawn in a radial direction from the center of the closure 4 and intersecting the major axis.

Figure 3:
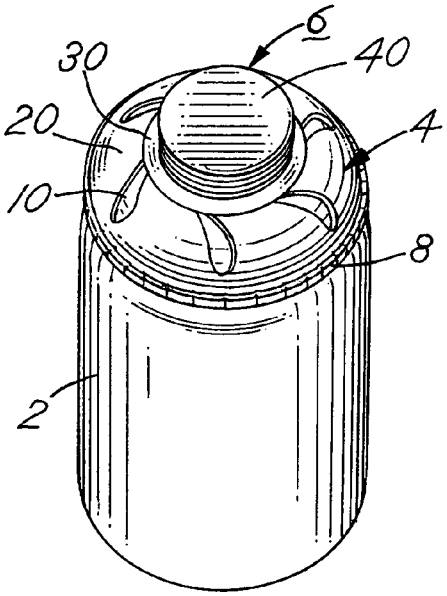
FIG. 3 is a perspective view of the can of FIG. 1 in an opened position, with the removable cap attached to the pour spout. Note that the pour spout is now in an extended position above the can body, facilitating pouring of the beverage from the can.
Figure 4:
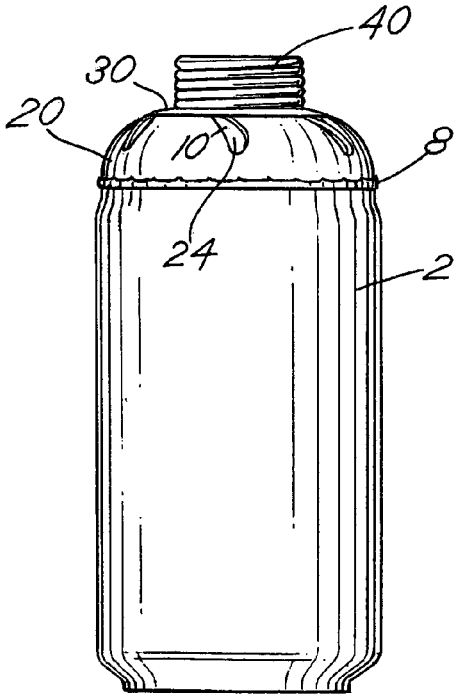
FIG. 4 is a side elevational view of the can of FIG. 3.

Depending on the thickness of the gauge material for the first and second layers it may be possible to omit the voids and yet still allow the closure to invert from the nested position (FIG. 1) to the elevated position (FIG. 3). Other designs for the void regions 24 are possible and may be arrived at using some routine experimentation, the idea being that the voids are arranged in a manner to facilitate extension of the pour spout from the beverage can after opening of the beverage can.

From the foregoing, it will be appreciated that we have disclosed a method of manufacturing a beverage can with a re-sealable spout. The method comprises the steps of a) forming a closure or end 4 as a laminate of a first layer 10 of material and a second layer 20 of material;

wherein a spout 6 is formed in the first layer of material 10 and a cap 40 covering the spout is formed in the second layer 20 of material; and b) affixing the closure to a can body 2. The affixing step can be by conventional seaming apparatus known in the art, e.g., the seaming apparatus used to seam conventional ends on aluminum beverage cans. The closure laminate is preferably, but not necessarily, constructed of aluminum alloys. In preferred embodiments, a scored area 44 is provided in the second layer 20 surrounding the base of the cap 40 enabling the cap to be twisted off, revealing the spout 6 in the first layer.

In yet another aspect, an end 4 for a beverage can forming a closure on a can body 2 is provided, comprising a laminate comprising a first layer 10 forming a pour spout 6 and a second layer 20 forming a cap 40, the laminate forming the body of the end and substantially completely filling the space within a rim 8 of the can body 2. A score pattern 44 is formed in the second layer 20 in an area surrounding the cap 40, the action of twisting the cap causing a rupture in the score pattern 44 allowing the cap 40 to be separated from the second layer 20 and removed from the pour spout (as shown in FIG. 5) and allowing access to the contents of the beverage can.

While the illustrated embodiment is an all-metal can, it is possible but less preferred to use other materials for the closure, including plastics, or a lamination comprising one layer of metal and a second layer of plastic. A lamination construction including additional layers is also possible.

Various other variations and modifications to the illustrated beverage can are contemplated as being within the scope of the invention. All questions concerning scope are to be resolved by reference to the appended claims and their legal equivalents.

We claim:

1. A beverage can with a pour spout, comprising:

a can body for containing a beverage; and a closure affixed to the can body comprising a pour spout and a cap covering the pour spout, the pour spout and cap nesting within the can body prior to opening the can, the closure made from a multi-layer structure and further comprising:

a first layer of the multi-layer structure forming the pour spout;

a second layer of the multi-layer structure forming the cap; and a scored area formed in the second layer, wherein the cap separates from the closure by breaking of the scored area and removing the cap from the pour spout; the cap and pour spout having complimentary thread structures allowing the cap to be installed over the pour spout and close the container.

2. The can of claim 1, wherein when the container is opened the pour spout is extendable from the can body to facilitate pouring of the beverage from the can body.

3. The beverage can of claim 1, wherein the first layer is a relatively thinner layer and the second layer is a relatively thicker layer, and wherein the second layer has a plurality of voids extending around the pour spout.

4. The beverage can of claim 1, further comprising a pad covering the scored area.

5. The beverage can of claim 2, wherein the pour spout further comprises a set of threads on the external surface of the pour spout and wherein the cap is adapted to thread onto the pour spout after separation from the closure enabling resealing of the beverage can.

6. The beverage can of claim 1, wherein the action of twisting the cap causing a rupture in the score pattern allowing the cap to be removed from the pour spout.

7. The beverage can of claim 1, wherein the first and second layers are made from an aluminum alloy, and wherein the second layer is a thicker gauge relative to the first layer.

8. A beverage can with a pour spout, comprising:

a can body for containing a beverage; and a closure for the can body having a pour spout and a cap covering the pour spout, the pour spout and cap nesting within the can body prior to opening the can, wherein the closure comprises a layered construction comprising a first layer forming the pour spout and a second layer forming the cap, the second layer having a relatively thicker gauge than the first layer and the second layer having a plurality of voids formed therein, the first and second layers extending substantially over the entire area of the closure in the region between the edge of the closure and the pour spout;

and wherein a score pattern is formed in the second layer in an area surrounding the pour spout and cap, the action of twisting the cap causing a rupture in the score pattern allowing the cap to be separated from the second layer and removed from the pour spout.

9. The can of claim 8, wherein the pour spout further comprises a set of threads on the external surface of the pour spout and wherein the cap is adapted to thread onto the pour spout after separation from the closure enabling resealing of the beverage can.

10. The beverage can of claim 8, further comprising a pad covering the scored area.

11. The beverage can of claim 8, wherein said first and second layers are made from an aluminum alloy.

12. The beverage can of claim 11, wherein the can body comprises a rim and wherein the first and second layers are seamed onto the rim of the can body.

13. The beverage can of claim 8, wherein the voids are formed in a regular pattern in the closure.

14. The beverage can of claim 13, wherein the regular pattern comprises a pattern of elongate voids.

15. The beverage can of claim 13, wherein the voids are arranged in a manner to facilitate extension of the pour spout from the beverage can after opening of the beverage can.

16. The beverage can of claim 14, wherein the elongate voids have a major axis and are arranged such that the major axis forms an acute angle to a line extending from the center of the closure in a radial direction and intersecting the major axis.

17. A method of manufacturing a beverage can with a re-sealable spout from an end closure and a can body, comprising the steps of:

a) forming the end closure from a multi-layer structure comprising a first layer of material and a second layer of material; wherein a spout is formed in the first layer of material and a cap covering the spout is formed in the second layer of material; and b) affixing the closure to the can body.

18. The method of claim 17, further comprising the step of forming a scored area in the second layer in the vicinity of the cap whereby the scored area is fractured by twisting the cap, enabling the cap to be removed from pour spout and allowing access to the contents of the beverage can.

19. The method of claim 17, wherein the affixing of the closure to the can body forms a rim to the can body, and wherein the second layer further comprises a plurality of void features formed therein and spaced in a region between the rim of the can body and the pour spout.

20. The method of claim 17, wherein the first and second layers are made from an aluminum alloy.

21. The method of claim 17, wherein the closure nests within the can body when the closure is in a closed condition, and wherein the closure is extendable from the can body such that the pour spout extends substantially beyond the can body, facilitating pouring the beverage from the beverage can through the pour spout.

22. An end for a beverage can forming a closure on a can body, comprising a multi-layer structure comprising a first layer forming a pour spout and a second layer forming a cap, the multi-layer structure forming the body of the end and substantially completely filling the space within a rim of the can body; and a score pattern formed in the second layer in an area surrounding the pour spout and cap, the action of twisting the cap causing a rupture in the score pattern allowing the cap to be separated from the second layer and removed from the pour spout.

23. The end of claim 22, wherein the second layer has a relatively thicker gauge than the first layer and the second layer having a plurality of voids formed therein.

24. The end of claim 22, wherein the end has a substantially convex shape wherein the pour spout and cap are at or below the level of the rim of the can body when the end is affixed to the can body.

25. The end of claim 22, wherein the end is made from an aluminum alloy.

26. The end of claim 22, wherein the second layer further comprises a plurality of void features formed therein and spaced in a region between the rim of the can body and the pour spout.

27. A beverage can comprising:

a can body and an end affixed to said can body;

wherein the end comprises a pour spout and a cap covering the pour spout, and wherein the end is formed as a multi-layer structure comprising a first inner layer forming the pour spout and a second outer layer forming the cap, the cap removable from the pour spout to allow pouring of the contents from the can body and closing off the pour spout to reseal the beverage can.

28. The beverage can of claim 27, wherein the end is in a substantially concave position when affixed to the can body, and wherein the end is moveable from the substantially concave position to a substantially convex position to facilitate pouring of the contents of the beverage can.

29. The beverage can of claim 27, wherein the first and second layers comprise aluminum alloys.

* * * * *